United States Patent [19]

Wolf

[11] Patent Number: 4,688,712

[45] Date of Patent: Aug. 25, 1987

[54] DEVICE FOR JOINING CONTIGUOUS BEAMS BY MEANS OF NAILING PLATES

[75] Inventor: Johann Wolf, Scharnstein, Austria

[73] Assignee: Johann Wolf Gesellschaft m.b.H. KG., Scharnstein, Austria

[21] Appl. No.: 800,169

[22] Filed: Nov. 20, 1985

[30] Foreign Application Priority Data

Nov. 26, 1984 [AT] Austria ..... 3740/84

[51] Int. Cl.[4] ..... B25C 7/00

[52] U.S. Cl. ..... 227/152; 100/913

[58] Field of Search ..... 100/DIG. 13; 227/110, 227/111, 152

[56] References Cited

U.S. PATENT DOCUMENTS

| | | | |
|---|---|---|---|
| 3,362,322 | 1/1968 | Moehlenpah | 227/152 X |
| 3,402,869 | 9/1968 | Otis | 227/152 |
| 3,716,179 | 2/1973 | Frydenberg et al. | 227/152 X |
| 4,287,822 | 9/1981 | Bowser | 227/152 X |
| 4,295,591 | 10/1981 | Lundström | 227/152 X |

FOREIGN PATENT DOCUMENTS

| | | | |
|---|---|---|---|
| 1627825 | 1/1971 | Fed. Rep. of Germany . | |
| 3002770 | 7/1980 | Fed. Rep. of Germany . | |
| 1314398 | 4/1973 | United Kingdom . | |
| 2006664 | 5/1979 | United Kingdom | 227/152 |
| 703327 | 12/1979 | U.S.S.R. | 227/152 |
| 852548 | 8/1981 | U.S.S.R. . | |

*Primary Examiner*—Paul A. Bell

*Attorney, Agent, or Firm*—Young & Thompson

[57] ABSTRACT

A device (1) for impressing nailing plates (4) into beams (5, 6) to be joined together comprises a unit (3) with pressure platens (12, 12') for impressing the nailing plates (4), and a unit (7) movably mounted with respect to this unit (3), for compressing the beams (5, 6). The device (1) is fashioned to be displaceable in the longitudinal direction of the beams (5, 6) by way of rollers (23, 28, 34) or like guide means.

2 Claims, 10 Drawing Figures

DEVICE FOR JOINING CONTIGUOUS BEAMS BY MEANS OF NAILING PLATES

Figure 1:
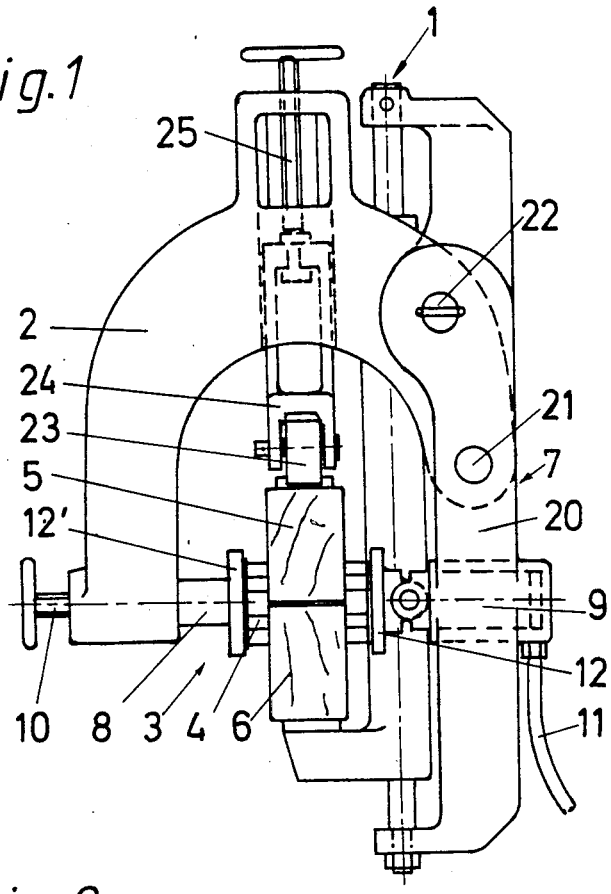

The invention relates to a device for pressing nailing plates into contiguous beams or the like, with a unit for compressing the beams or the like, into which the nailing plate(s) is (are) to be impressed, and with at least one unit, independently operable from this former unit, for pressing the nailing plates into the beams or the like pressed against each other, this latter unit exhibiting mutually opposed pressure platens, of which at least one can be advanced by a drive motor, the effective direction of the unit for compressing the contiguous beams or the like extending perpendicularly to the effective direction of the unit for impressing the nailing plate(s).

The manufacture of composite girders and, respectively, the erection of roof and frame structures at building sites could be substantially simplified and accelerated by the use of nailing boards. The pressing in of nailing plates with hammer blows, which could be practiced at building sites, does not result in a flush joining of the beams and therefore causes reduced load-bearing ability. Besides, the nailing plates are frequently destroyed during this operation, and relatively large nailing plates cannot at all be installed in this way.

Therefore, devices have been proposed for the mechanical impressing of nailing plates. None of these nailing presses, disclosed, for example, in DAS No. 1,627,825, British Pat. No. 1,314,398, or DOS No. 3,002,770, exhibits a means for pressing together the beams or the like to be joined.

A device of the type mentioned hereinabove, including a means for compressing the beams to be joined, has been disclosed in USSR Invention Disclosure No. 852,548. In the installation of USSR Invention Disclosure No. 852,548, the means for pressing the beams together is rigidly affixed to the device so that the beams are in all cases in contact with the stationary abutment with one surface. Accordingly, problems encountered in aligning the nailing plate pressing arrangement with respect to the beams if the total width of the beams to be joined differs (as measured in the operative direction of the compressing device).

Another drawback of the conventional devices resides in that they are designed to be stationary, so that the long and heavy beams must be moved.

It is an object of the invention to provide a readily portable device which can also be guided manually, making it possible to press nailing plates into wooden beams at building sites or any other desired locations, wherein the beams can be clamped together during the nailing process and need not be moved.

In order to attain this object, a device is provided according to the invention which is distinguished in that the unit for impressing the nailing plate(s) is arranged on a bracket-shaped support; that the unit for pressing the beams or the like together is mounted on an auxiliary frame connected to the support; that the auxiliary frame is retained on a guide means provided at the support, so that the frame can be pivoted and/or moved upwards and downwards with respect to the support; and that the support is displaceable along the beams or the like by way of guide members, such as rollers, runners, or the like.

The device of this invention has the advantage, first of all, that it can be moved in the longitudinal direction of the beams to be joined, which is substantially simpler, and, above all, more compact than moving long and heavy beams in their longitudinal direction.

Due to the special structure of the clamping unit or collet of the device according to the invention, the collet can be swung out of gripping engagement with the beams, which simplifies handling of the device of this invention. Furthermore, the special mounting of the collet provides the advantage that it can adjust freely to the beams to be joined together, so that the device is not altered in its position during the clamping together step. With the aid of collet fashioned according to this invention, the beams are clamped together at a small distance from the nailing point, directly prior to impressing the nailing plates.

According to one feature of the invention, the provision is made that one of the pressure platens is designed at the support as a fixedly attached abutment optionally adjustable by an adjusting spindle. This embodiment requires only one pressure medium motor and is made possible by the special mounting of the collet.

The provision can be made, in one embodiment, to provide, on the auxiliary frame of the unit for compressing the beams or the like to be joined, at the bottom an abutment fixedly joined to the auxiliary frame and at the top a pressure platen advanceable by way of a pressure medium motor. Preferably, in this embodiment, the support has a longer leg, and the guide means for auxiliary frame is arranged on the longer leg of the support.

The feature of this invention, that the guide members such as rollers or the like are attached to the support so that their level is adjustable, offers the advantage that the middle of the pressure platens for impressing the nailing plates can be respectively centered with respect to the contact area of the beams even in the case of beams having differing thicknesses. This adjustment can be made by means of a spindle or by way of a pressure medium motor.

Various possibilities for moving the device along the beams are proposed within the scope of this invention. Thus, the provision can be made that downwardly extending rollers are provided on the support, these rollers contacting from above the upper beam of the beams to be joined. In this connection, an embodiment proves to be advantageous wherein the rollers are mounted on the support to be adjustable transversely to the effective direction of the unit for impressing the nailing plate(s), for example with the aid of a spindle drive.

According to another embodiment, the support is provided with upwardly extending rollers over which the device can travel along a substantially horizontally extending rail, the mounting of the rail comprising bearing means for the beams to be joined together.

Furthermore, the provision can be made within the scope of this invention to arrange rollers travelling along the ground at the free ends of the support. These rollers, attached to the free ends of the bracket-shaped support, are preferably fashioned to be vertically adjustable.

In another, preferred embodiment of the device of this invention, the provision is made that guide members, such as rollers, runners, or the like, are mounted on the free ends of the support and engage into U-rails attached to the floor, the webs of the U-rails being aligned standing on edge, and the guide members engaging the U-rails from the outside or preferably from the inside. These U-rails absorb part of the forces occuring during the impressing of the nailing plate so that the bracket-shaped support can be of a weaker construction. In this embodiment, provision can also be made to arrange bearing means for the beams on the floor, as a lower abutment of the device for compressing the beams to be joined together.

Instead of arranging the guide means, such as rollers and the like, to be adjustable on the support, it is also possible within the scope of this invention to mount the pressure platens to be vertically adjustable on the support, optionally together with the pressure medium motors operating these platens.

In one version of the device of this invention, the device is distinguished in that both pressure platens are advanceable by pressure medium motors for impressing the nailing plates into the beams to be joined, and in that the pressure medium motors are connected with each other preferably by way of a pressure-equalizing means.

Consequently, the invention makes available a nailing clamp, for example a hydraulic nailing clamp, which can be supplied with a pressure medium via pressure hoses from a set-down hydraulic installation, the nailing clamp pressing, with a pressure cylinder, a disc platen of limited movability against an abutment, which latter is affixed to the device and can be selectively pivoted out of the way. The nailing clamp can travel by means of rollers or the like along the beams to be nailed, or along an auxiliary frame arranged in parallel thereto, this frame being mounted at beam level, therebelow, or thereabove; or it can be movable along rails or simply on the ground.

The advancement of the clamp is effected manually or by means of driven rollers as an automatically movable device.

The collet, and particularly its bracket-like support, is fashioned so that the arm with the abutment can be swung away, and then locked again, when moving past possible obstacles, such as laterally attached supports, brackets, etc.

The nailing plates are tacked on, for example by hammer blows, at the intended spacings prior to being impressed. Nailing plates with elongated nails are particularly advantageous for this purpose.

Prior to placement of the nailing plates, the beams are pressed together with the aid of the clamping unit provided in the device, so that these beams are in flush contact with each other.

In order to be able to join beams of different thicknesses, the spacing between the pressure platens of the unit for impressing the nailing plate and the traveling rollers is adjustable with the aid of a spindle or hydraulically so that the center of the disc respectively comes to lie in the zone of the contact area of the beams. In this arrangement, either the supporting members and/or the pressure platens—the latter optionally together with their pressure medium motors—can be adjustable.

Two handles mounted in spaced-apart relationship serve for guiding the device, and, for deployment at beam level, an adjusting block with an inclined plane can be used, or a winch for hoisting the device. Normally, the beams are placed on trestles, pedestals, etc. so that they lie approximately horizontally, and the device is readily displaceable, resting with the traveling rollers on the topside of the upper beams.

However, the traveling rollers can also be arranged within the device so that these rollers are resting on an adjustable rail. It is also possible to provide an elongated rack with holders for supporting the beams, this rack exhibiting a guide rail in parallel to the beams, the device being movable along this rail. In this connection, the guide rail can be located in any desired position with respect to the beams; preferably, this guide rail is mounted at a spacing above the beams, similarly to an overhead trolley, in order to keep the operating zone as unimpeded as possible.

The device can also be utilized so that the beams are placed in juxtaposition for nailing.

Within the scope of the invention, the collet for compressing the beams to be joined can also be of a different structure than the one described thus far. The device of the type discussed above can thus also be distinguished in that the unit for impressing the nailing plate(s) is arranged on a bracket-like support; that the unit for pressing the beams or the like together exhibits at least one pressure medium motor connected to the support, this motor forcing the beams or the like against an abutment; and that the support is displaceable along the beams or the like by way of guide members, such as rollers, runners, or the like. This embodiment is distinguished by great simplicity without impairment of its function.

In this embodiment of the device of this invention, the abutments can be of differing design. It is possible, for example, to provide, at the free ends of the support, rollers travelling along the ground, and to use as the abutment a crossbar, subtending the beams and affixed preferably releaseably to the legs of the support. In accordance with a modification of the invention, provision can be made that guide members, such as rollers, runners, or the like are arranged at the free ends of the support and engage U-rails mounted on the floor, and webs of the U-rails being oriented on edge and the guide members engaging the U-rails from the outside or preferably from the inside; and that bearing means for the beams are provided on the floor as the lower abutment of the unit for compressing the beams to be joined.

Figure 3:
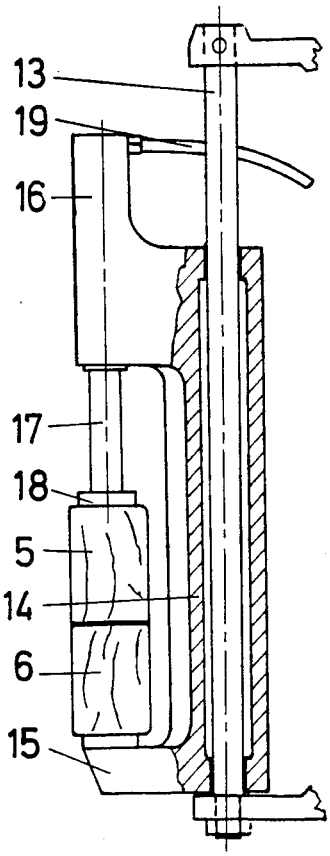
Figure 2:
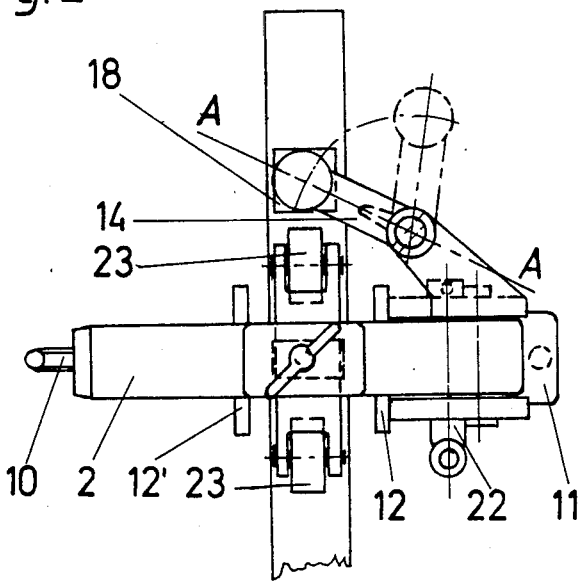
Figure 5:
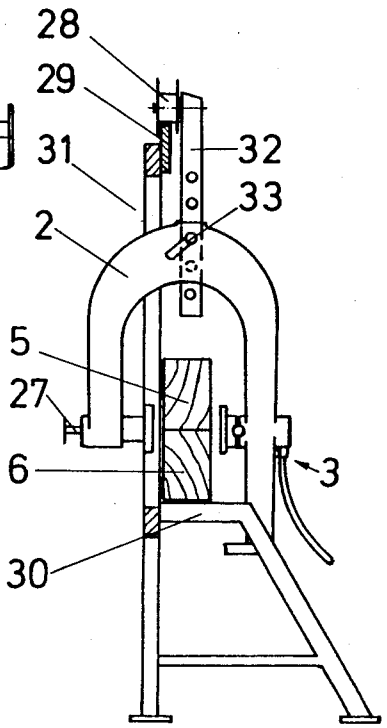
Figure 4:
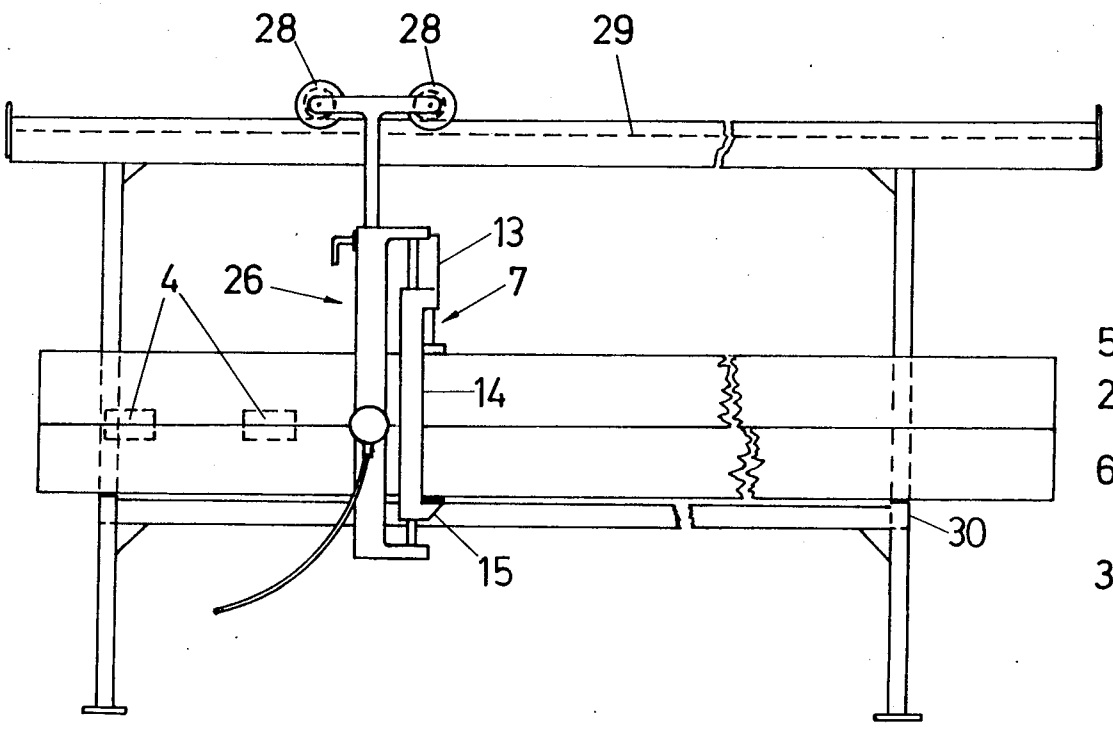
Figure 6:
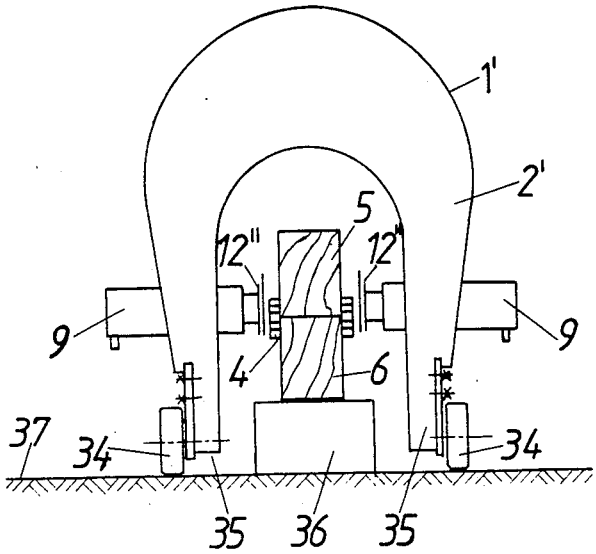
Figure 7:
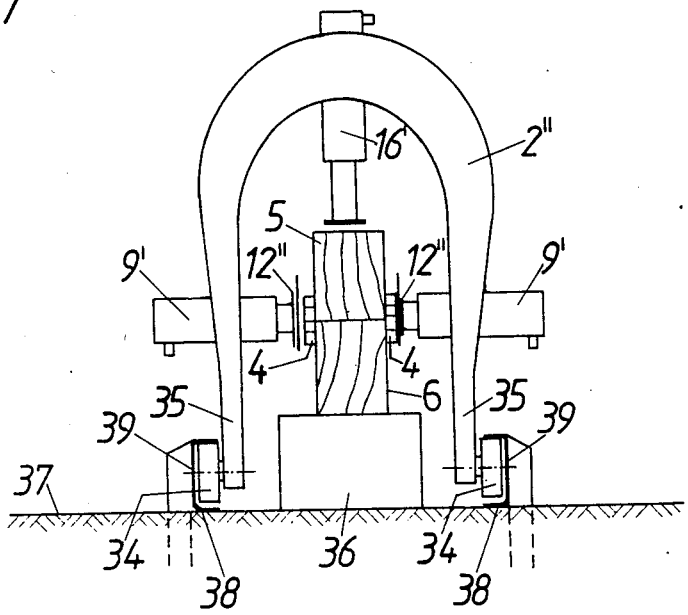
Figure 8:
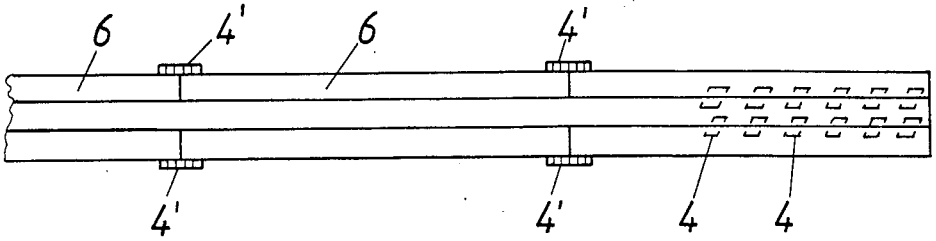
Figure 9:
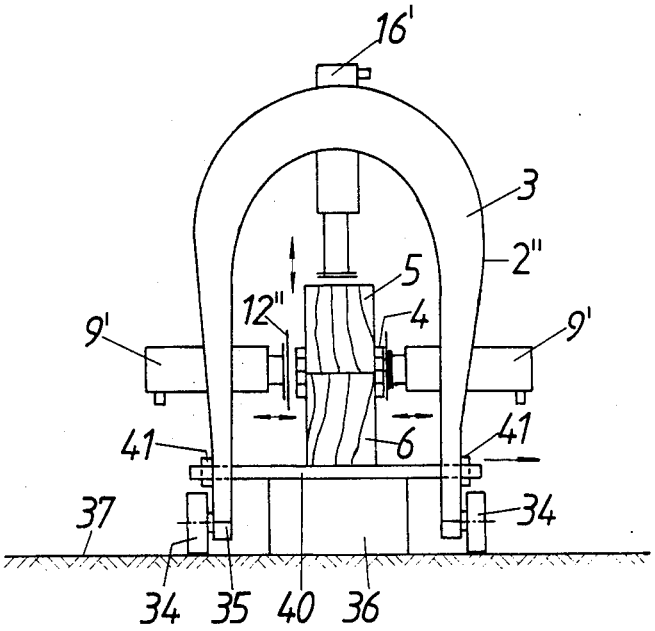
Figure 10:
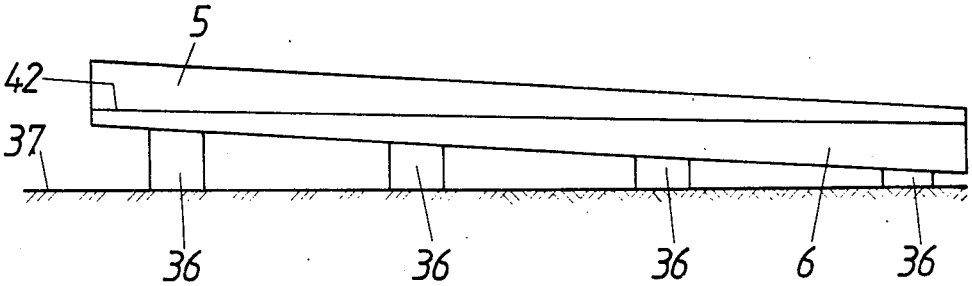

Additional details and features of the invention can be derived from the following description of the embodiments illustrated in the drawings wherein:

FIG. 1 shows, in a lateral view, a device with adjustable abutment and vertically adjustable rollers, FIG. 2 is a top view of the device of FIG. 1, the collet being shown in dashed lines in its swung-away position, FIG. 3 shows the collet in a section along line A—A in FIG. 2, FIG. 4 shows a second embodiment, FIG. 5 shows the arrangement of FIG. 4 in a side view, FIG. 6 shows an embodiment movable along the floor, FIG. 7 shows an embodiment movable in U-rails, FIG. 8 illustrates possibilities for locations where nailing plates can be impressed into the beam with the aid of the device according to the invention, FIG. 9 shows a further embodiment, and FIG. 10 shows the arrangement of beams with an oblique contact surface.

The embodiment of the device 1 comprising a nailing clamp according to this invention, shown in FIGS. 1, 2 and 3, comprises a support 2 which, in the illustrated example, is fashioned as an essentially U-shaped bracket. A unit 3 for impressing nailing plates 4 into beams or the like of wood 5 and 6 and furthermore a unit 7 in the shape of a collet for compressing the beams 5 and 6 at least during impression of the nailing plates 4 are arranged on the support 2.

It can be seen from FIG. 1 that the directions of operation of the units 3 and 7 are perpendicular to each other.

The unit 3 comprises two pressure platens 12, 12' of which one 12 can be moved toward the beams 5 and 6 by means of a pressure medium cylinder 9 that can be acted upon by a pressure medium by way of a conduit 11. The other pressure platen 12' is guided on the support 2 in a guide means 8 and can be placed in the desired positions by means of an adjusting device 10 in correspondence with the width of the beams 5 and 6. Upon advancement of the pressure platen 12, the nailing plates 4 are pressed into the beams 5, 6 by the pressure platens 12 and 12'.

The unit 7 for compressing the beams 5 and 6 during the pressing of the nailing plates 4 into the beams 5 and 6 exhibits an auxiliary frame 14, displaceably mounted on a guide means 13 with respect to the support 2; this auxiliary frame exhibits an abutment 15 at the bottom and a pressure medium motor 16 at the top, the piston rod 17 of the pressure medium motor 16 comprising a pressure platen 18 which can be advanced toward the abutment 15 to press the beams 5, 6 together. For this purpose, the pressure medium motor 16 can be supplied with pressure medium via a conduit 19.

As illustrated in FIGS. 2 and 3, the auxiliary frame 14 is pivotably mounted on the guide means 13 with respect to the support 2 so that the unit 7 can be swung away from its operative position to the position shown in dot-dash line in FIG. 2.

The leg 20 of the support 2, on which the guide means 13 for the unit 7 is arranged, has a joint 21 so that the device 1 can be tilted, the pressure platen 12' thus moving away from the beams 5 adn 6, so that the device 1 can be moved past supports, brackets, and the like projecting from the beams 5 and 6. During use of the device 1 in accordance with its purpose, the free pivotability of the leg 20 of the support 2 is precluded by insertion of a pin 22.

In order to be able to shift the device 1 along the beams 5 and 6, its support 2 is equipped with rollers 23 in contact from above with the upper beam 5. The mounting 24 for the rollers 23 is adjustable with respect to the support 2 with the aid of a threaded spindle 25 or with the aid of a pressure medium cylinder (not shown), so that the device 1 can be aligned with respect to the beams 5 and 6 in such a way that the pressure platens 12, 12' of the unit 3 are always centered with respect to the contact surface between the beams 5 and 6 whenever nailing plates 4 are to be pressed in place.

The embodiment of the device 26 of this invention as shown in FIGS. 4 and 5 has a structure corresponding to the embodiment illustrated in FIGS. 1–3, with respect to the support 2 and the units 3 and 7 mounted thereon. In this arrangement, though not shown in FIGS. 4 and 5, the support 2 can have a leg 20 that can be swung away, as in the embodiment illustrated in FIG. 1.

As in the device 1, the unit 3 for impressing the nailing plates 4 into the beams 5 and 6 here comprises a pressure medium cylinder associated with the pressure platen like platen 12, while the pressure platen shown on the left-hand side in FIG. 5 is fashioned as an abutment affixed to the device, the position of this abutment being adjustable with the aid of an adjusting spindle 27 or the like with respect to the support 2. However it is also possible to associate with both pressure platens pressure medium motors which can be simultaneously supplied with a pressure medium, or other drive mechanisms for advancing purposes, so that, during impressing of nailing plates, both pressure platens move toward the beams 5 and 6.

It can be seen from FIGS. 4 and 5 that the device 26 is suspended displaceably on a horizontal rail 29 by way of rollers 28 arranged above the device. For centering the pressure platens of the unit 3 with respect to the contact surface of the beams 5 and 6 resting on essentially horizontal bearing means 30 of the rack 31 carrying the rail 29, the support is connected to the rollers 28 by way of a perforated strip 32 and a peg 33, thereby to be adjustable vertically.

Handles for shifting the devices to and from and/or for swinging the unit 7 for clamping the beams 5 and 6 together outwardly or back into contact are provided on the devices 1 and 26, for example on the support 2 thereof, optionally also on the auxiliary frame 14. These handles are not shown in the drawings for the sake of simplicity. There is a guide means 13 for the auxiliary frame and an abutment 15.

FIG. 6 shows a nailing device 1' supported on the ground 37, the supporting wheels 34 of which are mounted vertically adjustably on the free ends 35 of the support 2'. The pressure cylinders 9 for impressing the nailing plates 4 are located on both sides and in communication with each other by way of a pressure-equalizing means. Alternatively, or also additionally, the pressure platens 12" are vertically adjustable on the pistons of the cylinders 9. Blocks 36 or the like, which are spaced apart, serve as bearing means for the beams 5 and 6.

FIG. 7 shows an embodiment of the device of this invention which is guided along the floor 37 in U-rails 38. The vertical adjustment takes place with the aid of movable pressure platens 12" or with the aid of pressure medium motors 9' that can be moved up and down. The support 2" is of weaker construction, since it is supported on both sides in the U-rails 38 during the pressing step. In the same way, the U-rails act as abutments during the compressing of the beams 5 and 6 with the aid of the unit corresponding to the units 7, in this case a fluid pressure motor 16', the lower beam 6 being in contact with blocks 36 or the like. These blocks 36 accordingly act as the lower abutment for the unit 16' for compressing the beams 5 and 6.

The device of this invention can also be used for impressing nailing plates 4' in the zone of joints of beam girders composed of several sections. For this purpose, the unit 7 is utilized for pressing the beams together. This possibility is illustrated in FIG. 8. The nailing plates 4 are impresed with the aid of the unit 3 comprising pressure platens 12, and the nailing plates 4' are impressed, preferably previously, with the aid of the unit 7.

In the embodiments illustrated in FIGS. 7 and 9, the unit 7 for compressing the beams 5, 6 to be joined together is constituted by a press ram with pressure medium cylinder 16', mounted on the support 2" approximately in the center thereof, acting downwardly. The possibilities shown in FIGS. 7 and 9 can be employed, inter alia, for supporting the beams from below during the clamping together step.

In the example of FIG. 9, a crossbar 40 is provided as the abutment, this bar being inserted, for example, in openings in the legs of the support 2", and the underside of this bar, measured away from the ground 37, being located at the same level as the topside of the bearing means 36. This can be brought about, if necessary, by vertical adjustment of the rollers 34.

The crossbar 40 can be pulled out laterally in case the device is to be shifted in the region of a bearing means. In order to be able to use the crossbar 40 additionally as a support for the legs of the support 2" during the impressing of nailing plates 4 into the beams 5 and 6, stops 41 are provided on the crossbar 40, contacting the legs of the support 2" from the outside. At least one of the stops 41 is removable to be able to pull the crossbar 40 out while the device is being shifted past a bearing means 36.

In the embodiment of FIG. 7, the abutment is constituted by the bearing means 36; during the clamping together of the beams 5, 6 to be joined, lifting of the support 2" in the upward direction is prevented by the rollers 34 engaging in the U-rails 38.

It may also happen that the beams 5 and 6 to be joined are those wherein the contact surface 42 of the beams 5 and 6 does not extend in parallel to the supporting surfaces (for example in case of oppositely conical or wedgeshaped beams). In this instance, the contact surface of the beams 5 and 6, if the bearing means 36 had the same height, would extend obliquely sloping upwardly or downwardly. In order to avoid this happening, and to avoid the need for constant readjustment of the platens 12", the provision can be made that the bearing means 36 (FIG. 7) of 30 (FIGS. 4, 5) increase in height (i.e. define, in total, an inclined supporting surface) in such a way that the contact surface extends in parallel to the traveling path (for example the ground 37) of the device, as indicated schematically in FIG. 10.

What is claimed is:

1. A device for pressing nailing plates into contiguous beams comprising: a bracket-shaped support (2', 2"); two pressure medium cylinders (9) mounted on opposite sides of said bracket-shaped support (2', 2") and comprising pistons; pressure platens (12') mounted on each said piston of said pressure cylinders; guide rollers (34) mounted on free ends of said bracket-shaped support (2', 2") wherein said bracket-shaped support (2',2") moves along the ground through the action of said guide rollers and said pressure medium cylinders (9) advance said opposite pressure platens toward a contiguous beam for impressing nailing plates into said beams as said bracket moves along the floor, said guide rollers (34) being engaged in U-rails (38) mounted on the floor, bearing means (36) arranged on the floor between said U-rails to support said contiguous beams, and a pressure medium motor (16') mounted at the top of said bracket-shaped support (2") for vertically adjusting a plate for pressing said contiguous beams together.

2. A device for pressing nailing plates into contiguous beams comprising: a bracket-shaped support (2); a compressing unit (7) for compressing the beams together; and at least one impressing unit (3) for pressing the nailing plates (4) into the beams, wherein, the impressing unit is independently operable from said compressing unit and the operating direction of the compressing unit is perpendicular to the operating unit of the impressing unit, the impressing unit comprises mutually opposed pressure platens (12, 12') of which at least one (12) can be advanced by a drive motor (9), the impressing unit being carried by said bracket-shaped support (2), and the compressing unit (7) for pressing the beams together is mounted on the support (2), upwardly extending rollers (28) provided on the support (2), the impressing unit (3) being movable by way of these rollers along an essentially horizontally extending rail (29) located above the support, and a mounting (31) of the rail (29) exhibiting beam bearing means (30) located below the beams to provide support.

* * * * *